United States Patent [19]

Niino et al.

[11] Patent Number: 4,537,051

[45] Date of Patent: Aug. 27, 1985

[54] CONTROL DEVICE FOR SUCCESSIVE ROLLING MILL

[75] Inventors: Shuhei Niino; Koichi Ishimura; Ken Okamoto; Koichi Ohba, all of Hyogo, Japan

[73] Assignee: Mitsubishi Denki Kabushiki Kaisha, Tokyo, Japan

[21] Appl. No.: 427,340

[22] Filed: Sep. 29, 1982

[30] Foreign Application Priority Data

Sep. 30, 1981 [JP] Japan ..... 56-157211

[51] Int. Cl.[3] ..... B21B 37/02; B21B 37/12

[52] U.S. Cl. ..... 72/12; 72/16

[58] Field of Search ..... 72/12, 16, 235, 9

[56] References Cited

U.S. PATENT DOCUMENTS 3,526,113 9/1970 McNaugher ..... 72/235

4,386,511 6/1983 Morita ..... 72/16

FOREIGN PATENT DOCUMENTS 5039067 12/1975 Japan ..... 72/12

*Primary Examiner*—E. Michael Combs

*Attorney, Agent, or Firm*—Sughrue, Mion, Zinn, Macpeak, and Seas

[57] ABSTRACT

A rolling mill control device detects a dimension or dimensions of a product material between two mill stands, and forecasts a width deviation value of the material at a downstream stand on the basis of rolling characteristics of the material, etc. The position of an upstream stand is then varied to reduce the forecast value to zero. Feedback control is also effected on the position of the upstream stand based upon the difference between a reference width and an actually measured value.

4 Claims, 4 Drawing Figures

CONTROL DEVICE FOR SUCCESSIVE ROLLING MILL

BACKGROUND OF THE INVENTION

This invention relates to a rolling mill having a grooved roll such as a bar or wire rolling mill in which the dimensions of a rolling material are controlled.

One example of the arrangement of a successive rolling mill of this type is shown in FIG. 1.

The successive rolling mill comprises i stands. In FIG. 1, reference numeral 1 designates a mill stand; 2, a #2 stand; 3, a #i-1 stand; 4, a #i stand; and 5, the rolling material. The successive rolling mill in FIG. 1 is a so-called VH type rolling mill. That is, horizontal rolling machines (the odd-numbered stands in FIG. 1) and vertical rolling machines (the even-numbered stands in FIG. 1) are alternately arranged.

For instance, the #i-1 stand rolling machine 3 is a vertical rolling machine which carries out rolling in the direction X. In FIG. 1, reference character bi-1 designates the lateral width of the rolled material at the output of the #i-1 rolling machine, and reference character hi-1 designates the height thereof. The #i rolling machine is a horizontal rolling machine which carries out rolling in the direction Y. Reference character bi designates the lateral width at the output thereof, and reference character hi designates the height.

In a conventional successive rolling mill such as a bar or wire rolling mill, in order to reduce tension of the material between the stands equal to zero, loop control or a tension control mechanism has been employed. However, a successive rolling mill in which the dimensions of the rolling material are dynamically controlled has yet to be provided in the art because of the following reasons:

(1) The tolerances on the dimensions of the products have not been severe, and (2) Elongation of the mill due to a variation in the load during rolling is small. (This reduces the effect of transmitting a variation of a rolling material at the input side to the delivery or output side, and therefore the accuracy of product dimension is not greatly varied.)

Thus, the conventional control is disadvantageous in that the dimensional accuracy is low, because, for example, the dimensional variation due to variations in the temperature of the rolling material is not controlled at all.

SUMMARY OF THE INVENTION

This invention has been made in view of the foregoing drawbacks and it is an object thereof to perform rolling with high dimensional accuracy by forecasting the width deviation of the material from a reference dimension at the delivery side of i-th stand by detecting actual dimension of a given two (i-1)-th and i-th stands. And according to this duration screw position of (i-1)-th stand is controlled. Together with mentioned above, the width of the rolling material at the delivery side of the i-th stand is actually detected, and the screw position of the (i-1)-th stand is controlled so that the deviation between the width detected and a reference width at the delivery side of the i-th stand is reduced to zero, whereby the dimensional accuracy in successive rolling is improved.

DETAILED DESCRIPTION OF THE PREFERRED EMBODIMENTS

Figure 1:
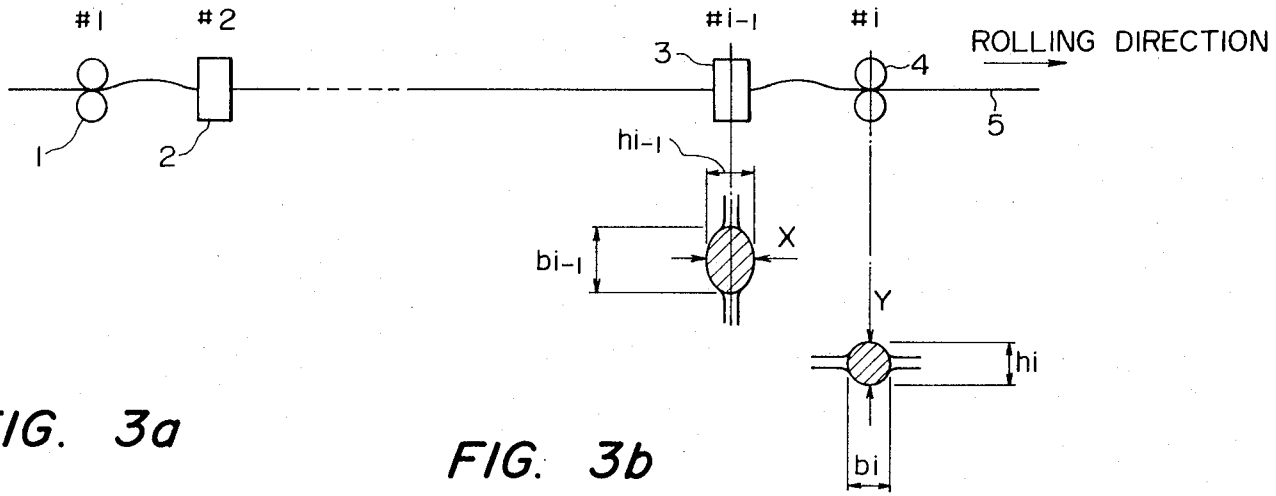
FIG. 1 is an explanatory diagram showing one example of the arrangement of a successive rolling mill.
Figure 3A:
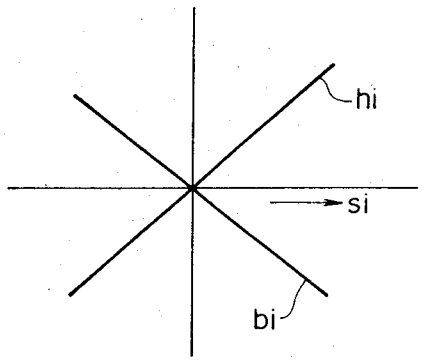
FIGS. 3*a* and 3*b* are characteristic diagrams indicating the relations between the height and width of a rolling material and the depression position of a rolling machine.
Figure 3B:
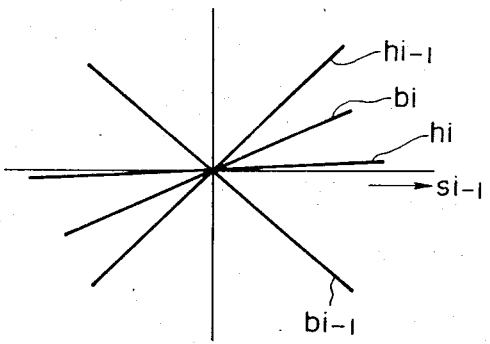
Figure 2:
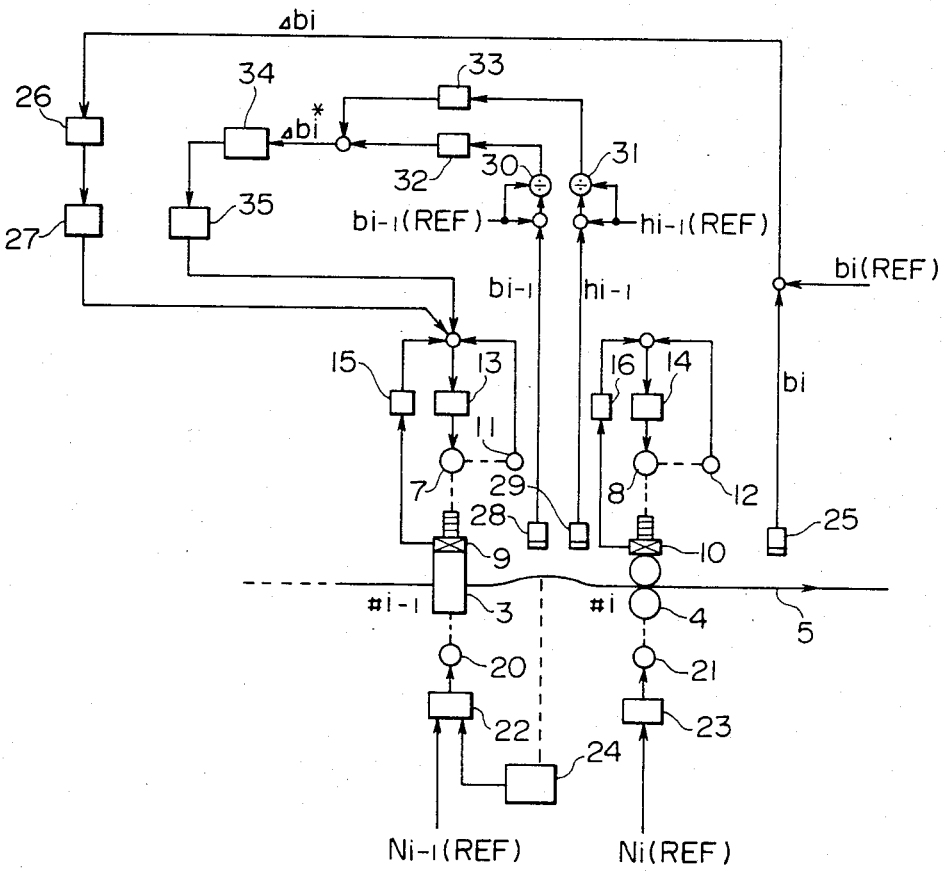
FIG. 2 is a block diagram showing a dimension control device according to one embodiment of this invention.

In FIG. 2, reference numeral 3 designates a #i-1 rolling machine; 4, a #i stand; and 5, a rolling material. Depressing or screwing down motors are provided for the stands, and load cells 9 and 10 detect rolling loads. Depression or screw position detecting pulse oscillators 11 and 12 are coupled to the motors 7 and 8, and motor driving thyristor devices 13 and 14 supply electric power to the motors 7 and 8. At 15 and 16 are shown mill spring control devices for the stands.

A motor 20 is provided for driving the rolling roll of the #i-1 stand, and a motor 21 is disposed for driving the rolling roll of the #i stand. Thyristor devices 22, 23 drive respective motors 20 and 21. A loop control device 24 maintains a given amount of loop between the #i-1 stand the #i stand, and a width detecting device 25 is arranged for detecting the width of the material at the output side of the #i stand. A gain controller 26 multiplies a difference Δbi between the width bi detected by the width detecting device 25 and a reference width bi(REF) by a predetermined control gain; and the output of the gain controller 26 is feed to a screw position controller 27, control gain which is a PI(D) controller, and by this controller a screw position correction signal is fed to the screw down motor of the #i-1 stand.

Further in FIG. 2, reference numeral 28 designates a width detecting device for detecting the width of the rolling material at the delivery or output side of the #i-1 rolling machine; and a height detecting device 29 detects the height of the same. In a divider 30, the difference between a detection value bi-1 of the width detecting device 28 and a reference width bi-1(REF) in the #i-1 stand is divided by the reference width bi-1(REF), and in a divider 31, the difference between a detection value hi-1 of the height detecting device 29 and a reference height hi-1(REF) for the #i-1 stand is divided by the reference height hi-1(REF).

A forecasting device 32 receives the output of the divider 30, for forecasting the change which will be caused in the width at the delivery side of the #i stand 4 by a change in the width at the delivery side of the #i-1 stand 3. Simultaneously, a forecasting device 33 receives the output of he divider 31, for forecasting a change which will be caused in the width at the delivery side of the #i stand 4 by a change in the height at the delivery side of the #i-1 stand. In a gain controller 34, the composite output of the forecasting devices 32 and 33 is multiplied by a predetermined control gain; and in a screw position controller 35, which is a PI(D) controller, and by this controller a screw position correcting signal is fed to the screw down motor of the #i-1 stand.

In most conventional systems, the loop control device 24 controls the speed of the motor 20 of the i-1 stand whose set speed was Ni-1 (REF) so that the amount of loop between the #i-1 stand 3 and the #i stand 4 is made constant. However, according to this system mentioned above only, the dimensions of the products are solely determined by the characteristics of the rolling machine, and therefore it is impossible to dynamically control the dimensions. A mill spring control method (BISRA control) is known in the art, in which, with the aid of the loads detected by the load cells 9 and 10, the mill spring controllers 15 and 16 detect variations in height, to control the screw positions. However, as it is impossible for the method to control dimensions in both directions (i.e. both width and height), the overall dimensions are poor in accuracy.

The operation of the control device according to the invention will now be described.

The width bi-1 and height hi-1 of the rolling material 5 are detected by the width detecting device 28 and the height detecting device 29 arranged on the delivery side of the #i-1 rolling machine 3. The difference Δhi-1 between the height hi-1 thus detected and the reference height hi-1 (REF) of the #i-1 stand is fed to the divider 31.

Similarly, the difference between the detected width bi-1 and the reference width bi-1(REF) is fed to the divider 30.

In the control device according to the invention, using the height deviation Δhi-1 and width deviation Δbi-1 detected at the delivery of the #i-1 stand, the width deviation Δbi at the delivery of the #i stand 4 is calculated, to eliminate width deviation Δbi at the delivery of the #i stand by feedback control.

In order to eliminate the width deviation at the delivery of the i-th machine 4, it is necessary to control the position of the stand 3, as described in detail below.

FIG. *3a* indicates height (hi) deviations and width (bi) deviations caused when the screw position Si of the #i stand rolling machine is deviated. FIG. *3b* indicates height (hi-1) and width (bi-1) deviations, and also height (hi) and width (bi) deviations at the delivery of the respective i-1th and i-th rolling machines caused when the screw position Si-1 of the #i-1 stand rolling machine is deviated.

A method of correcting the position Si of the #i rolling machine 4 and that Si-1 of the #i-1 rolling machine 3 are available in controlling the width bi at the delivery of the #i stand rolling machine, as is apparent from FIGS. *3a* and *3b*. When the screw position Si of te #i stand rolling machine is corrected, not only is the width bi, but also the height hi is changed. On the other hand, when the screw position Si-1 of the #i-1 stand rolling machine 3 is corrected, the height hi at the output of the i-th stand is scarcely changed. In the invention, based on this fact, the width deviation Δbi at the delivery of the #i stand is compensated by controlling the screw position of the #i-1 stand rolling machine 3. More specifically, according to the invention, the width deviation Δbi-1 and height deviation Δhi-1 at the delivery of the #i-1 stand rolling machine 3 are applied to the dividers 30 and 31, respectively, where they are divided by the reference width bi-1(REF) and reference height hi-1(REF) at the delivery of the #i-1 stand.

The output (hi-1(REF)−hi-1/hi-1(REF)) of the divider 31 represents a height deviation factor at the delivery of the #i-1 rolling machine 3, and the output (bi-1(REF)−bi-1/bi-1(REF)) of the divider 30 represents a width deviation factor at the delivery of the #i-1 stand.

The output of the divider 30 is applied to the forecasting device 32, while the output of the divider 31 is applied to the forecasting device 33.

The forecasting device 32 forecasts the width deviation at the delivery side of the #i stand using a coefficient representing the influence that the width deviation factor at the delivery of the #i-1 stand rolling machine 3 has on the width deviation at the delivery side of the #i rolling machine. On the other hand, the forecasting device 33 forecasts the width deviation at the delivery of the #i stand 4 using a coefficient representing the influence that the height deviation factor at the delivery of the #i-1 stand rolling machine 3 has on the width deviation at the delivery of the #i stand.

The outputs of the forecasting devices 32 and 33 take values which are determined from the characteristics of the rolling machines and the properties of the rolling material, and which can be calculated in advance. Accordingly, by combining the outputs of the forecasting devices 32 and 33, the forecast width deviation Δbi* at the delivery of the #i stand due to the height and width deviations at the delivery of the #i-1 rolling machine 3 can be obtained.

The forecast deviation Δbi* is applied to the gain controller 34. In the gain controller, in order to eliminate the forecast width deviation Δbi*, the composite output is multiplied by a predetermined gain for correcting the position of the #i-1 stand 3, to provide an output. The value of the control gain multiplier of the gain controller 34 can be calculated from the gradient of the bi deviation characteristic curve with Si-1 changed, in FIG. *3b*.

The output of the gain controller 34 is applied to the screw position controller 35. In the controller 35, the output of the gain controller 34 is subjected to PI(D) control, and a screw position correction signal is applied to the depressing device including the screw down motor 7, the pulse oscillator 11 and the motor driving thyristor device 13.

The motor 7 is driven by the motor driving thyristor device 11 until the screw position detected by the pulse oscillator 11 coincides with the screw position correction signal.

By this control, the width deviation at the delivery of the #i stand due to a deviation in the dimension of the material at the delivery of the #i-1 stand is compensated.

In the above-described system, the dimensions of the material at the delivery of the #i-1 stand are detected to control the dimensions of the material at the delivery of the #i stand, and therefore the control is excellent in response; however, the dimensional accuracy is not always sufficient.

In the invention, therefore, in order to obtain more satisfactory dimensional accuracy, the width detector 25 is provided at the delivery of the #i stand rolling machine 4, so that feedback control is carried out with actually measured values.

That is, the width is detected by the width detector 25 provided at the delivery of the #i stand rolling machine 4, and the difference Δbi between the width thus detected and the reference width bi(REF) at the delivery of the #i stand is applied to a gain controller 26. The gain controller 26 is similar in arrangement to the gain controller 34. The output of the gain controller 26 is supplied to a screw position control device 27, where the output of the gain controller 26 is subjected to PI(D) control, and similarly as in the case of the screw position control device 35, a screw position correction signal is applied to the screw device of the #i-1 stand.

In the above-described embodiment, the height detecting device 29 actually measures the dimension of the rolling material 5 at the delivery of the #i-1 stand; however, the dimension may be detected by other means, i.e. by calculating from the screw position Si-1 of the #i-1 stand, the mill spring constants and the rolling load.

Furthermore in the above-described embodiment, the height and width of the material at the delivery of the #i-1 stand are detected, so that the width deviation of the material at the delivery of the #i stand can be forecast from the percentages of deviation in the height and width thus detected. However, the width deviation of the material may be forecast by detecting only one of the height and width. Moreover, the forecast may be achieved by detecting the height and width of the material at a point upstream of the #i-1 stand instead of at the delivery of the #i-1 stand.

As is apparent from the above description, according to the invention, the deviation in the dimension of the material between any two stands is utilized to forecast the width deviation of the material at the delivery of the #i stand located downstream, and the screw position of the #i-1 stand rolling machine is controlled so that the width deviation thus forecast is reduced to zero; and the width of the material at the delivery of the #i stand rolling machine is actually measured, and the screw position of the #i-1 stand is controlled so that the difference between the width thus measured and the reference width of the material at the delivery of the stand is reduced to zero. Therefore, the controller of the invention is excellent in response and can perform rolling control with high accuracy.

What is claimed is:

1. A control device for a successive rolling mill having alternating vertical and horizontal roll stands for rolling a material in the width and height directions, respectively, comprising:

an (i-1)-th vertical roll stand and an i-th horizontal roll stand for screwing down on a material through the roll gaps of the stands;

first dimension detecting means for detecting a dimension of said rolling material at the output side of said (i-1)-th stand;

first dimension deviation computing means for computing and providing a dimension deviation factor indicative of the deviation between a reference dimension of said rolling material at the output side of said (i-1)-th stand and the detected dimension from said dimension detecting means, said deviation factor representing the deviation as a percentage of the reference dimension;

forecasting means, responsive to said deviation factor, for providing a forecast output representing a forecast change in the width dimension of said rolling material at the output side of said i-th roll stand;

width dimension detecting means for detecting and providing the actual width dimension of said rolling material at the output side of said i-th stand;

width dimension deviation computing means for computing and providing as an output the deviation between the actual width dimension provided by said width dimension detecting means and a reference width dimension; and screw control means for controlling the screwing down of the roll gap in said (i-1)-th stand in accordance with the forecast output of said forecasting means and the output of said width dimension deviation computing means so that said deviation of the actual width dimension at the output side of said i-th stand is zeroed.

2. A control device as claimed in claim 1, wherein said first dimension detection means detects the width dimension of said rolling material at the output side of said (i-1)-th stand, and said first dimension deviation computing means computes and provides a width dimension factor representing the deviation of the width dimension between a reference width dimension of said material and the width dimension detected by said first dimension detecting means, as a percentage of the reference width dimension.

3. A control device as claimed in claim 1, wherein said first dimension detecting means detect the height dimension of said material at the output side of said (i-1)-th stand, and said first dimension deviation computing means computes and provides a height dimension factor representing the deviation between a reference height dimension of said material and the height dimension detected by said first dimension detecting means, as a percentage of the reference height dimension.

4. A control device as claimed in claim 1, wherein said first dimension detecting means detects width and height dimensions of said material at the output state of said (i-1)-th stand, and said first dimension deviation computing means computes and provides a width dimension factor and a height dimension factor representing the respective deviations of the width dimension and height dimension between a reference width dimension of said material and the width dimension detected by said first dimension detecting means and between a reference height dimension of said material and the height dimension detected by said dimension detecting means, respectively, as percentages of the respective reference width and reference height dimensions; and wherein said forecasting means is responsive to both of the deviation factors for providing said forecast output.

* * * * *